US009724796B2

(12) United States Patent
Xue et al.

(10) Patent No.: US 9,724,796 B2
(45) Date of Patent: Aug. 8, 2017

(54) WHEEL POLISHING APPARATUS

(71) Applicant: CITIC Dicastal CO., LTD, Qinhuangdao (CN)

(72) Inventors: Bowen Xue, Qinhuangdao (CN); Yacong Zhang, Qinhuangdao (CN); Jiandong Guo, Qinhuangdao (CN); Yongning Wang, Qinhuangdao (CN); Zhihua Zhu, Qinhuangdao (CN); Changhai Li, Qinhuangdao (CN); Binyu Xiong, Qinhuangdao (CN)

(73) Assignee: CITIC DICASTAL CO., LTD., Qinhuangdao (CN)

( * ) Notice: Subject to any disclaimer, the term of this patent is extended or adjusted under 35 U.S.C. 154(b) by 42 days.

(21) Appl. No.: 14/981,614

(22) Filed: Dec. 28, 2015

(65) Prior Publication Data

US 2016/0184955 A1 Jun. 30, 2016

(30) Foreign Application Priority Data

Dec. 29, 2014 (CN) ..... 2014 1 0834535

(51) Int. Cl.
*B24B 9/04* (2006.01)

(52) U.S. Cl.
CPC ..... *B24B 9/04* (2013.01)

(58) Field of Classification Search
CPC ..... B24B 9/04
USPC ..... 451/49, 283, 246, 249, 254, 258, 63
See application file for complete search history.

(56) References Cited

U.S. PATENT DOCUMENTS 4,009,409 A * 2/1977 Buescher ..... H01J 29/04 313/337
6,217,424 B1 * 4/2001 Stephens ..... B24B 5/44 451/254
6,722,961 B2 * 4/2004 Solanellas ..... B23Q 1/54 451/140
2002/0142708 A1 * 10/2002 Bilinovich, Sr. ..... B24B 5/44 451/49

* cited by examiner

*Primary Examiner* — Robert Rose
(74) *Attorney, Agent, or Firm* — Hamre, Schumann, Mueller & Larson, P.C.

(57) ABSTRACT

The present invention relates to a wheel polishing apparatus composed of a frame, motors, servo electric cylinders, a polishing head, guide rails and the like. A wheel is fixed onto the clamp on the platform, a motor I rotates the platform and the wheel via the main shaft, a motor II rotates the polishing head via the drive shaft; the canting servo electric cylinder can realize the relative movement of the polishing head along the contour line of the back cavity of the wheel via the canting guide rail, the horizontal servo electric cylinder can realize constant contact between the polishing head and the back cavity of the wheel via the horizontal guide rail. The invention can realize the function of automatically polishing the back cavity of the wheel, which has desirable effects and advanced process and high degree of automation, and is characterized by simple construction and low cost.

1 Claim, 2 Drawing Sheets

WHEEL POLISHING APPARATUS

TECHNICAL FIELD

The present invention relates to a polishing apparatus, and more particularly to a polishing apparatus for the back cavity of a wheel.

BACKGROUND ART

In the production of a vehicle hub, deburring is a very important procedure. A wheel is put on a special deburring machine in the conventional method for deburring, which, owing to the special configuration of the back cavity of the wheel, cannot achieve desirable effect in most cases. Therefore, to ensure the qualified rate of coating, the wheel needs to be polished manually. Manual polishing is not only labor intensive, but would generate dust during the polishing process, which can pose significant hazard on human body. This apparatus can automatically polish and obtain good effects.

INVENTION CONTENTS

The object of the invention is to provide a wheel polishing apparatus which can realize the automatic polishing function of the back cavity of a wheel.

In order to accomplish the above-mentioned object, the technical solutions of the invention are that: a wheel polishing apparatus is composed of a frame, a horizontal servo electric cylinder, a horizontal guide rail, a cushion block, a motor I, a main shaft, a canting plate, a canting guide rail, a sliding plate, a canting servo electric cylinder, a platform, a clamp, a polishing head, a drive shaft and a motor II, the cushion block is fixed above the frame via the horizontal guide rail; the horizontal servo electric cylinder is mounted at the left side of the frame, and the output rod of the horizontal servo electric cylinder is connected with the cushion block; above the sliding plate is mounted the main shaft and below the sliding plate is fixed the motor I, and the sliding plate is fixed onto the canting plate via the canting guide rail; the canting servo electric cylinder is fixed at an end of the canting plate, and the output rod of the canting servo electric cylinder is connected with the sliding plate; the clamp is mounted above the platform, the low portion of which is fixed at the top end of the main shaft; the motor II with its output end connected with the drive shaft is fixed at a corresponding position on the top end of the frame, and the polishing head is mounted below the drive shaft.

In one aspect of the invention, a wheel polishing apparatus is provided, which is composed of a frame (1), a horizontal servo electric cylinder (2), a horizontal guide rail (3), a cushion block (4), a motor I (5), a main shaft (6), a canting plate (7), a canting guide rail (8), a sliding plate (9), a canting servo electric cylinder (10), a platform (11), a clamp (12), a polishing head (13), a drive shaft (14) and a motor II (15), and characterized in that: the cushion block (4) is fixed above the frame (1) via the horizontal guide rail (3); the horizontal servo electric cylinder (2) is mounted at the left side of the frame (1), and the output rod of the horizontal servo electric cylinder (2) is connected with the cushion block (4); above the sliding plate (9) is mounted the main shaft (6) and below the sliding plate (9) is fixed the motor I (5), and the sliding plate (9) is fixed onto the canting plate (7) via the canting guide rail (8); the canting servo electric cylinder (10) is fixed at an end of the canting plate (7), and the output rod of the canting servo electric cylinder (10) is connected with the sliding plate (9); above the platform (11) is mounted the clamp (12), and the lower portion of the platform (11) is fixed at the top end of the main shaft (6); the motor II (15) with its output end connected with the drive shaft (14), is fixed at a corresponding position on the top end of the frame (1), and the polishing head (13) is mounted below the drive shaft (14).

In use, a wheel is fixed onto the clamp on the platform, the motor I rotates the platform and the wheel via the main shaft, and the motor II rotates the polishing head via the drive shaft; the canting servo electric cylinder can realize the relative movement of the polishing head along the contour line of the back cavity of the wheel via the canting guide rail, and the horizontal servo electric cylinder can realize constant contact between the polishing head and the back cavity of the wheel via the horizontal guide rail.

In practice, the invention can realize the function of automatically polishing the back cavity of a wheel, which has not only desirable effects, but also advanced process and high degree of automation, and is characterized by simple construction and low manufacturing cost.

DESCRIPTION OF DRAWINGS

The embodiments of the invention will be described in detail below with reference to the accompanying drawings, wherein.

Figure 1:
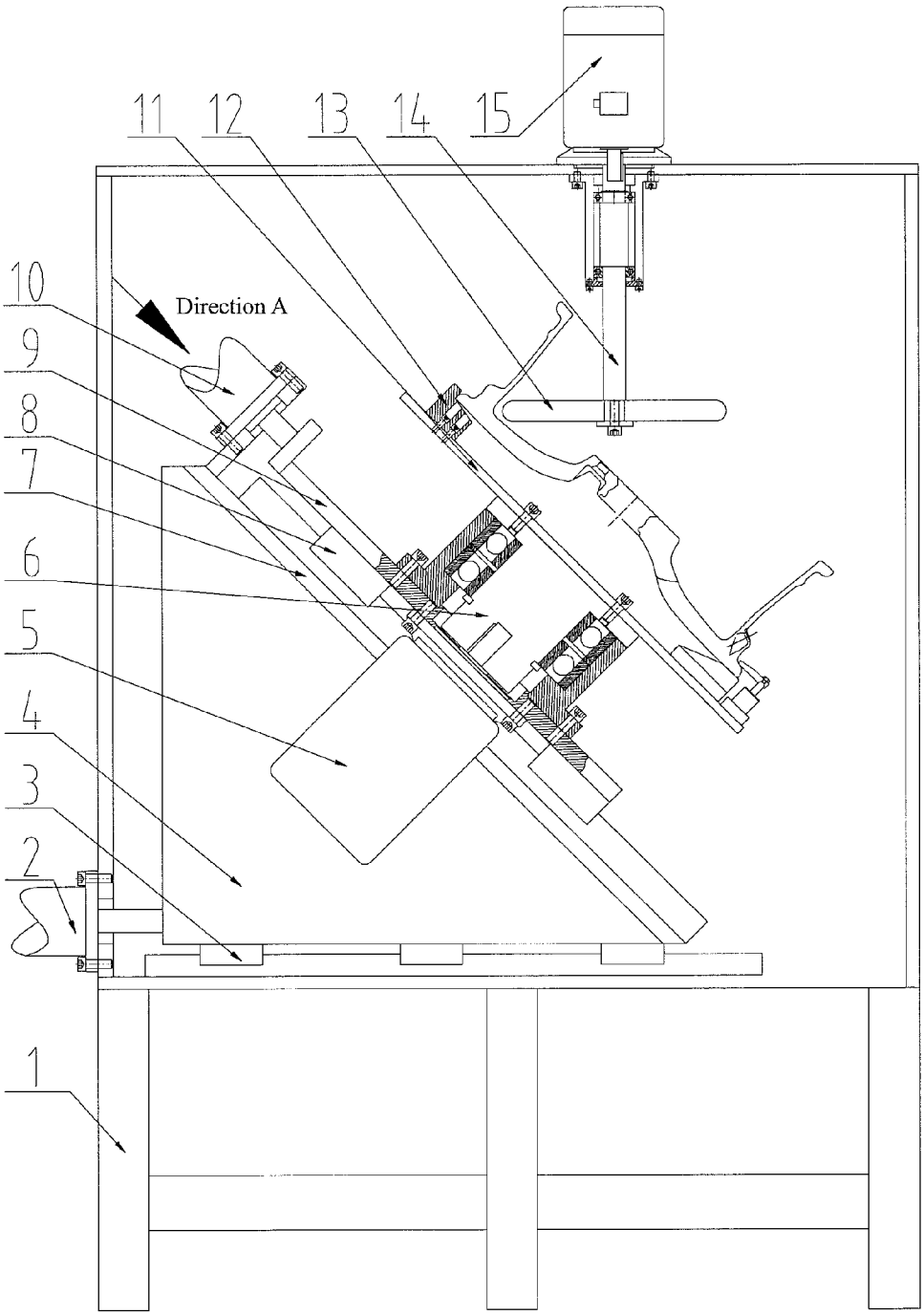
FIG. 1 is a front view of a wheel polishing apparatus of the present invention.
Figure 2:
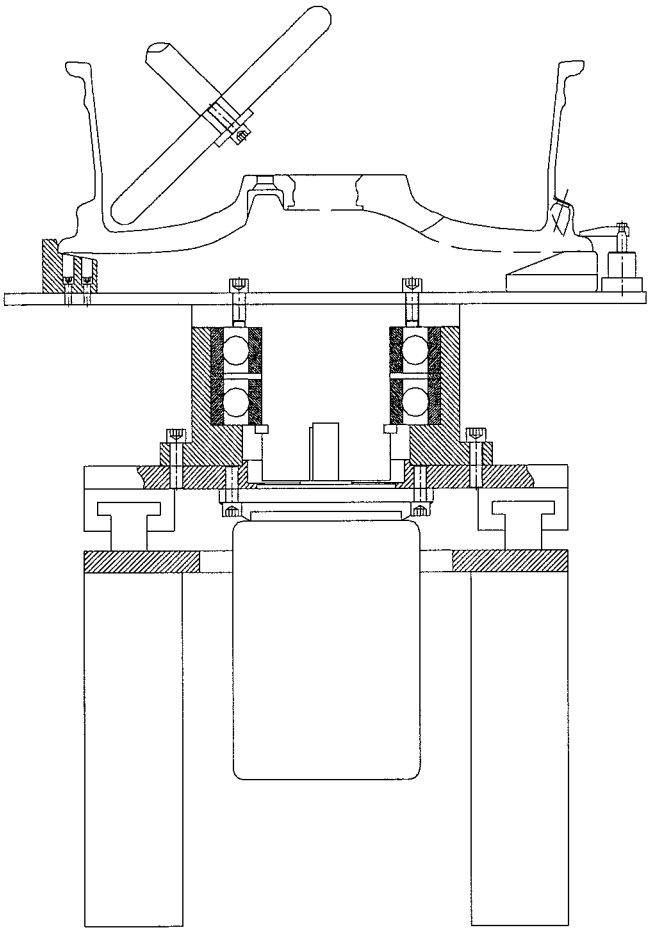
FIG. 2 is a view of a wheel polishing apparatus of the present invention in direction A.

In the drawings, 1-frame, 2-horizontal servo electric cylinder, 3-horizontal guide rail, 4-cushion block, 5-motor I, 6-main shaft, 7-canting plate, 8-canting guide rail, 9-sliding plate, 10-canting servo electric cylinder, 11-platform, 12-clamp, 13-polishing head, 14-drive shaft, 15-motor II.

DETAILED DESCRIPTION

The details and operation condition of the specific apparatus set forth in accordance with the present invention will be described below with reference to the accompanying drawings.

The apparatus is composed of a frame 1, a horizontal servo electric cylinder 2, a horizontal guide rail 3, a cushion block 4, a motor I 5, a main shaft 6, a canting plate 7, a canting guide rail 8, a sliding plate 9, a canting servo electric cylinder 10, a platform 11, a clamp 12, a polishing head 13, a drive shaft 14 and a motor II 15, and the cushion block 4 is fixed above the frame 1 via the horizontal guide rail 3; the horizontal servo electric cylinder 2 is mounted at the left side of the frame 1, and the output rod of the horizontal servo electric cylinder 2 is connected with the cushion block 4; above the sliding plate 9 is mounted the main shaft 6 and below the sliding plate 9 is fixed the motor I 5, and the sliding plate 9 is fixed onto the canting plate 7 via the canting guide rail 8; the canting servo electric cylinder 10 is fixed at an end of the canting plate 7, and the output rod of the canting servo electric cylinder 10 is connected with the sliding plate 9; above the platform 11 is mounted the clamp 12, and the lower portion of the platform is fixed on the top end of the main shaft 6; the motor II 15 with its output end connected with the drive shaft 14, is fixed at a corresponding position at the top end of the frame 1, and the polishing head 13 is mounted below the drive shaft 14.

During operation, a wheel is fixed onto the clamp 12 on the platform 11, the motor I 5 rotates the platform 11 and the wheel via the main shaft 6, the motor II 15 rotates the polishing head 13 via the drive shaft 14; the canting servo electric cylinder 10 can realize the relative movement of the polishing head 13 along the contour line of the back cavity of the wheel via the canting guide rail 8, and the horizontal servo electric cylinder 2 can realize constant contact between the polishing head 13 and the back cavity of the wheel via the horizontal guide rail 3.

The invention claimed is:

1. A wheel polishing apparatus, consisting of a frame (1), a horizontal servo electric cylinder (2), a horizontal guide rail (3), a cushion block (4), a motor I (5), a main shaft (6), a canting plate (7), a canting guide rail (8), a sliding plate (9), a canting servo electric cylinder (10), a platform (11), a clamp (12), a polishing head (13), a drive shaft (14) and a motor II (15), characterized in that:

the cushion block (4) is fixed above the frame (1) via the horizontal guide rail (3); the horizontal servo electric cylinder (2) is mounted at the left side of the frame (1), and the output rod of the horizontal servo electric cylinder (2) is connected with the cushion block (4); above the sliding plate (9) is mounted the main shaft (6) and below the sliding plate (9) is fixed the motor I (5), the sliding plate (9) is fixed onto the canting plate (7) via the canting guide rail (8); the canting servo electric cylinder (10) is fixed at an end of the canting plate (7), and the output rod of the canting servo electric cylinder (10) is connected with the sliding plate (9); above the platform (11) is mounted the clamp (12), and the lower portion of the platform (11) is fixed at the top end of the main shaft (6); the motor II (15) with its output end connected with the drive shaft (14), is fixed at a corresponding position at the top end of the frame (1), and the polishing head (13) is mounted below the drive shaft (14).

* * * * *